US005943872A

United States Patent [19]

Sakurada et al.

[11] Patent Number: 5,943,872

[45] Date of Patent: Aug. 31, 1999

[54] AIR CONDITIONER

[75] Inventors: Hiroshi Sakurada; Yoshimi Kawai, both of Kawasaki, Japan

[73] Assignee: Fujitsu General Limited, Kawasaki, Japan

[21] Appl. No.: 09/083,946

[22] Filed: May 26, 1998

[30] Foreign Application Priority Data

Jun. 20, 1997 [JP] Japan ..... 9-163837
Dec. 29, 1997 [JP] Japan ..... 9-369631

[51] Int. Cl.[6] ..... F25D 23/12

[52] U.S. Cl. ..... 62/262; 62/404; 454/315; 454/155

[58] Field of Search ..... 454/285, 315, 454/319, 321, 316, 155; 62/404, 262

[56] References Cited

U.S. PATENT DOCUMENTS 4,782,999 11/1988 Ishii ..... 236/49
5,234,373 8/1993 Yamazaki ..... 454/319
5,340,357 8/1994 Nagai ..... 454/155
5,626,517 5/1997 Kil ..... 454/315
5,658,197 8/1997 Kil ..... 454/319
5,797,792 8/1998 Kotoh ..... 454/320

*Primary Examiner*—Henry Bennett
*Assistant Examiner*—Melvin Jones
*Attorney, Agent, or Firm*—Kanesaka & Takeuchi

[57] ABSTRACT

In an air conditioner, a supporting base having a plurality of bearing cylinder portions is attached to an outlet of a housing of the air conditioner. Each shaft of wind horizontally direction plates is located in the outlet of the housing and is disposed in the bearing cylinder portion through first and second bearing bushes. The first bearing bushes hold the wind horizontally direction plates in a cantilever manner. A heat insulation material is adhered onto the supporting base. The wind horizontally direction plates can be easily attached to the air outlet after the heat insulation material is installed, and the moisture condensation is prevented.

14 Claims, 11 Drawing Sheets

AIR CONDITIONER

BACKGROUND OF THE INVENTION

1. Field of the Invention

This invention relates to an air conditioner, more particularly, to the attaching structure of a wind directing plate to an air outlet of, for example, a ceiling-mounted air conditioner.

2. Description of the Related Art

A ceiling-mounted air conditioner is mainly used to be mounted on the ceiling in a wide space, such as in offices and shops, and structurally larger in size than, for example, a wall-mounted air conditioner.

An example of the conventional structure will be explained below with FIG. 10 to FIG. 12. The air conditioner has, as a whole, a flat box type housing 1 mounted on the ceiling face inside the room. Incidentally, in FIG. 10, the middle portion of the housing 1 is omitted owing to the circumstances of the drawing.

An air inlet 2 is formed on one end portion of the bottom surface of the housing 1. An air outlet 3 is formed on a corner portion, opposite from the air inlet 2, of the housing 1. The air inlet 2 and the air outlet 3 are connected to each other through an air channel in the housing 1. In the air channel, an air fan 4 and a heat exchanger 5 are placed. In the lower part of the heat exchanger 5, a drain pan 6 is placed.

The air outlet 3 has an opening which is formed diagonally downward from the ceiling to the room. The air outlet 3 is provided therein with a wind vertically directing plate (flap) 7 and a wind horizontally directing plate (louver) 8. The wind vertically directing plate 7 is capable of turning in the vertical direction about the horizontal rotation axis X. The wind horizontally directing plate 8 is capable of turning in the lateral direction about the rotation axis Y orthogonal to the horizontal rotation axis X of the wind vertically directing plate 7.

In the conventional example, the number of the wind vertically directing plates 7 is two. FIG. 10 shows only one wind horizontally directing plate 8, but in the actual air conditioner, plural wind horizontally directing plates 8 are provided at predetermined spaced-intervals in a direction at right angles to the drawing. When referring to all wind horizontally directing plates 8, the expression is a wind horizontally directing plate group.

The wind vertically directing plates 7 and the wind horizontally directing plates 8 are provided in the air outlet 3 by attaching on a base frame 9. As shown in FIG. 11 and FIG. 12, the base frame 9 is composed of a plastic frame_ having a landscaped box shape, including an upper plate 9*a*, a lower plate 9*b*, and side plates 9*c* which are provided at both ends of the upper and lower plates 9*a* and 9*b*. The air outlet 3 is substantially formed with the base frame 9.

The ceiling-mounted air conditioner is larger in size as compared with the wall-mounted air conditioner, so that the air outlet 3 is also large, and naturally, larger wind directing plates 7 and 8 than that used in the wall-mounted type are provided in the air outlet 3. For the supporting strength of the wind horizontally directing plate 8, rotating shafts 8*a* and 8*b* are provided on the top side and the bottom side of the wind horizontally directing plate 8 to support the plate 8 at the two points of top and bottom.

More specifically, the base frame 9 is formed to be a rectangular box shape as described above. Bearing holes 10*a* and 10*b* are provided on the upper plate 9*a* and the lower plate 9*b*. The upper rotating shaft 8*a* and the lower rotating shaft 8*b* are inserted through bearing bushes 11*a* and 11*b* into the bearing holes 10*a* and 10*b*, respectively.

In this case, arms 12 are connected in a line to each of the bearing bushes 11*a* for the upper rotating shaft 8*a* as shown in FIG. 11. The arms 12 are coupled to each other through a coupling rod 13 which moves reciprocatingly by a motor 14 (see FIG. 10). Each of the wind horizontally directing plates 8 is driven in the right and left directions within predetermined angles by the motor 14.

The wind vertically directing plate 7 is attached to the base frame 9 by inserting the rotating shaft 7*a* into a bearing hole 15 which is provided on the side plate 9*c* of the base frame 9 so as to be vertically movable against the base frame 9. In this case, because of the wind vertically directing plate 7 being long, supporting plates 16 are provided at predetermined spaced-intervals between the upper plate 9*a* and the lower plate 9*b* of the base frame 9. The supporting plate 16 is provided with a hinge 16*a* which supports the middle portion of the rotating shaft 7*a* of the wind vertically directing plate 7.

The wind vertically directing plate 7 and the wind horizontally directing plate 8 are attached to the base frame 9 as described thus far, and then the assembled body is installed in the air outlet 3. These processes entail the following tasks.

That is, it is difficult to adhere a heat insulation material on the inside of the base frame 9 which is a rectangular box shape, and a number of bearing holes 10*a* and 10*b* are provided on the upper plate 9*a* and the lower plate 9*b*.

The moisture condensation may occur in the base frame 9, and may grow to drop from the air outlet 3. This problem is resolved by adhering the heat insulation material on the inside of the base frame 9. The adhering process, however, needs a lot of time and efforts; resulting in inferior productivity and high cost.

The base frame 9 is a resin molding and has a structure of a rectangular box shape, which requires plural molds, so that the cost is increased. In addition, in order to attach the base frame 9 into the air outlet 3 with a good outside appearance, careful and elaborate finishing is required, and this also causes the increase of the cost.

The wind horizontally directing plate 8 is supported at top and bottom points with a shaft, so that the lower bearing bush 11*b* is required, which is unnecessary in case of a cantilever support. The lower bearing bush 11*b* is small in size and many bushes 11*b* are required, so that the assembling process needs further efforts.

Moreover, the supporting plate 16 is provided in the base frame 9 for supporting the middle portion of the wind vertically directing plate 7, so that the cost for the attaching process and the parts is required. In addition, the presence of the supporting plate 16 could cause a wind noise and could be detrimental to the design of the air outlet 3.

SUMMARY OF THE INVENTION

The present invention is aimed at resolving these disadvantages. It is a purpose of the invention to provide a ceiling-mounted type air conditioner which simplifies the installation structure of wind direction plates on an air outlet, enables to produce in low cost, and prevents the occurrence of moisture condensation.

In order to achieve the above purpose, the present invention includes a ceiling-mounted type housing having an air inlet and air outlet connected through an inside air channel. In an air conditioner in which a heat exchanger having a drain pan beneath thereof and an air fan are provided inside the air channel, at least one piece of a wind vertically directing plate vertically rotatable around a horizontally rotating shaft and a wind horizontally directing plate group including several pieces of wind horizontally directing plates rotatable in the right and left directions around rotating axes almost perpendicularly intersecting to the horizontally rotating axis, in the present invention, a rotating shaft extending upward from the top side along the rotating axis, having a predetermined length is provided on the wind horizontally directing plate, a supporting base having a bearing cylinder portion through which a rotating shaft of each wind horizontally directing plate is struck, is provided on the top plate of the housing which forms an upper portion of the air outlet, and each wind horizontally directing plate is supported through the rotating shaft and the bearing cylinder portion in a cantilever manner.

It is desirable in this case that a first and a second bearing bushes are provided on the upper end portion and the bottom end portion of the bearing cylinder portion. By this formation, the rotating shaft is securely supported by two point, the first bush on the upper end portion and the second bush on the bottom portion.

It is also one of the characteristics that the first and the second bushes are molded with a self-lubricant synthetic resin. As for such a resin, polyacetal resin is listed as an example, and a grade containing wax component is suitable among such resins.

When the wind horizontally directing plate is formed with a self-lubricant resin, by integrally forming the second bush with the rotating shaft, the number of parts can be reduced.

It is also cited as a characteristic of the present invention that arms continuously connected with coupling rods are provided on each first bush, and each wind horizontally directing plate is connected with each other through the arm of the first bush and the coupling rod.

It is preferable for making the assembling work easy that plural coupling holes are formed at predetermined spaced-intervals on the coupling rod, and on the arm, there are provided a coupling pin which inserts to the coupling hole, and a flexible supporting portion holding the coupling rod inserted to the coupling pin in a detachable manner.

In order to improve the assembling work, it is advisable to provide at least a pair of engaging portions which is inserted to the first bush while elastically reducing the diameter thereof, and has a hook possible to engage the upper edge of the first bush on the upper portion of the rotating shaft, and to adopt an integrated formation of the coupling shaft with the first bush through the engaging portion so that no deviation in rotation occurs between relative rotation of the rotating shaft and the first bush.

In the present invention, an heat insulation material is adhered at a predetermined thickness on the surface of the air outlet of the supporting base. Since the supporting base is made of a board material having a simple shape, the heat insulating material can be easily adhered.

It is preferable that the bearing cylinder portion is provided to strike through the heat insulating material on the supporting base. With this formation, the length of the shaft of the bearing cylinder portion can be made long through the use of the thick of the heat insulation material, so that the rotating shaft of the wind horizontally directing plate is securely supported.

According to the present invention, a storage recess accommodating a driving device of the wind horizontally directing plate group can be formed on the heat insulation material, so that a limited space in the housing can be effectively used.

According to the present invention, at least one hinge supporting the middle portion of the rotating shaft of the wind vertically directing plate can be provided on the drain pan. The hinge is attached to the drain pan in a cantilever manner, so that the hinge does not become a cause for the wind noise, nor impair the design of the air outlet, because the hinge does not intersect the whole air outlet as in the case of the conventional manner.

The hinge is preferably molded with a self-lubricant synthetic resin, so that a bearing bush for the rotating shaft of the wind vertically directing plate can be omitted.

In the present invention, it is preferable that a driving device of the wind vertically directing plate is provided on the outside surface of the side wall of the air outlet, and a heat insulation material is adhered on the inside surface of the side wall so that a moisture condensation surface can be decreased.

As another characteristic of the present invention, it can be cited that a portion positioned at the lowest among the bottom sides of the wind horizontally directing plate is placed on the drain pan, so that dewdrops on the wind horizontally directing plate drop on the drain pan. According to this formation, when the moisture condensation occurs on the wind horizontally directing plate, the dewdrops are collected in the drain pan so that the dewdrops do not drop down from the air outlet.

In this case, it is preferable to position an intersecting point of the lateral line in the upstream side of the wind horizontally directing plate, taking the air outlet direction of the air outlet as a reference, with the bottom side, is placed at the lowest position, so that the conventional drain pan can be used without intentionally changing the size and shape of the drain pan.

In the present invention both shoulder portions on the top side are cut off at a predetermined angle from the root portion of the rotating shaft of the wind horizontally directing plate, as regards to an assumed standard line intersecting at a right angle with the rotation axis of the wind horizontally directing plate.

According to this formation, even if the heat insulation material adhered on the supporting base is expand downward and the clearance to the wind horizontally directing plate becomes narrow, since only a part around the rotating shaft contacts with the heat insulating material, there is no harmful influence to the rotation of the wind horizontally directing plate.

DETAILED DESCRIPTION OF THE PREFERRED EMBODIMENT(S)

Figure 1:
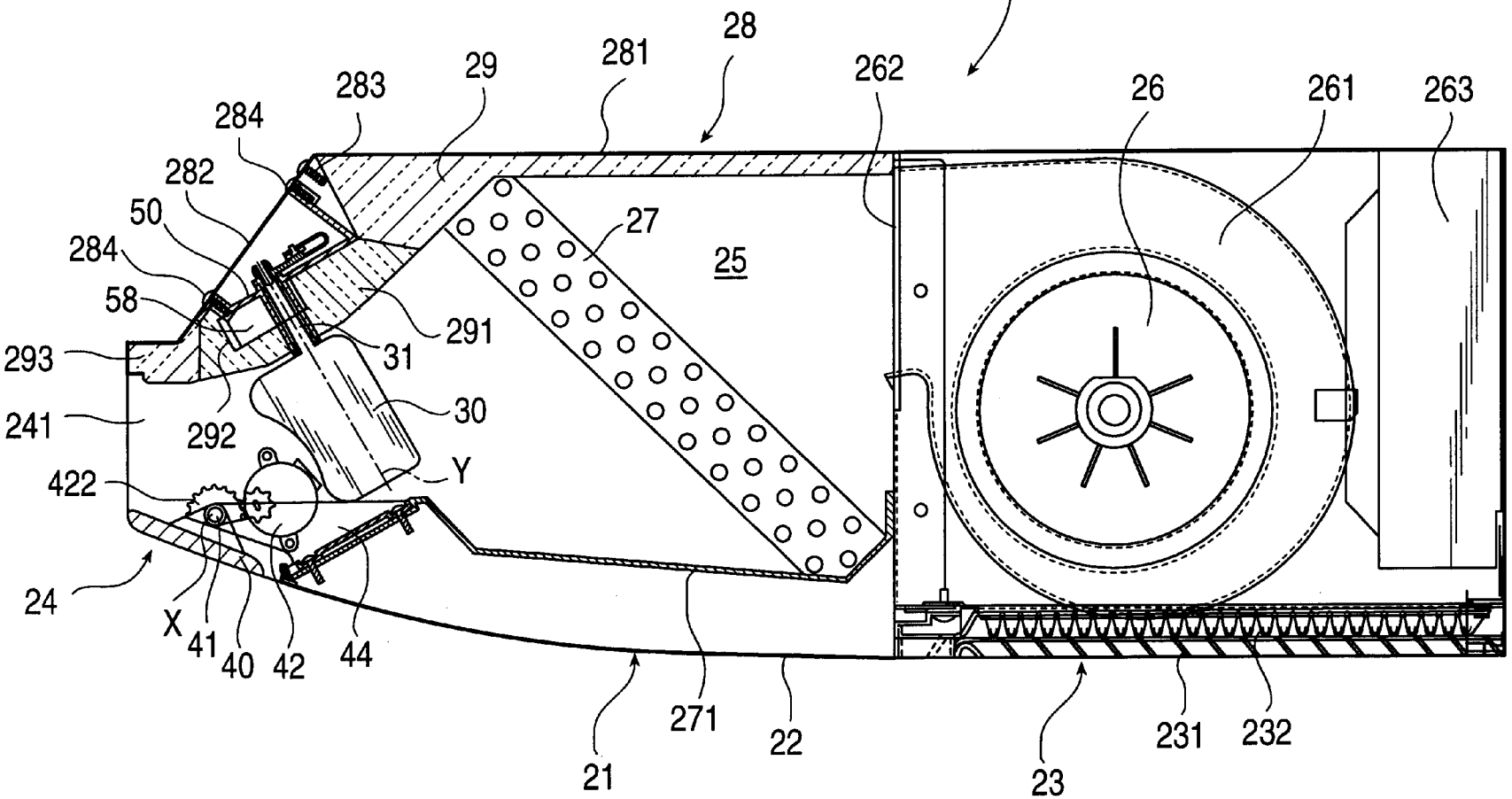
FIG. 1 is a sectional view showing an internal structure of an air conditioner of a first embodiment according to the present invention.

FIG. 1 to FIG. 4 show a first embodiment, in which FIG. 1 is a sectional view of a ceiling-mounted air conditioner 20 of the first embodiment and shows the entire structure. Similar in appearance to the conventional example described above, the air conditioner 20 has an entirely flat-box shaped housing 21 mounted on the ceiling face of the room.

The bottom surface of the housing 21, seen from the floor, is a front panel 22. On one end portion of the front panel 22, an air inlet 23 is provided. On the comer, opposite to the air inlet 23, of the housing 21, an air outlet 24 is provided. The air inlet 23 is provided with a decorative grill 231 and an anti-dust filer 232.

The air inlet 23 and the air outlet 24 are connected through an air channel 25 inside the housing 21. In the air inlet 23 side of the air channel 25, an air fan 26 is placed, surrounded with a fan casing 261. Note that an electrical equipment box 263 is placed adjacent to the fan casing 261 in the housing 21.

Inside the air channel 25 on an air blow opening 262 side of the fan casing 261, a heat exchanger 27 is placed opposite to the air blow opening 262. Under the heat exchanger 27, a drain pan 271 is provided for collecting the dewdrops dropping from the heat exchanger 27.

In the first embodiment, a top plate 28 of the housing 21 which faces the ceiling face of the room (not shown) includes a main top plate 281, directly attached onto the ceiling face, and a secondary top plate 282 secured by a screw 283 to extend in a downward diagonal direction from the main top plate 281. A heat insulation material 29 is adhered on the inner face of the main top plate 281 which confronts the heat exchanger 27. The secondary top plate 282 and the front panel 22 form a part of the air outlet 24.

The air outlet 24 is provided therein with a wind horizontally directing plate (louver) 30 and a wind vertically directing plate (flap) 40. The wind vertically directing plate 40 turns in the up-down direction about the horizontal rotation axis X. The wind horizontally directing plate 30 turns in the right-left direction about the rotation axis Y perpendicular to the horizontal rotation axis X of the wind vertically directing plate 40.

In the first embodiment, the number of the wind vertically directing plate 40 is one. The wind vertically directing plate 40 is composed of a belt shaped plate sizing as large as an approximate half of the opening of the air outlet 24. The wind vertically directing plate 40 is selectively turned clockwise from the first position at which the lower portion side of the opening is closed as shown in FIG. 1 to a second position at which the side portion of the opening is closed.

Figure 3:
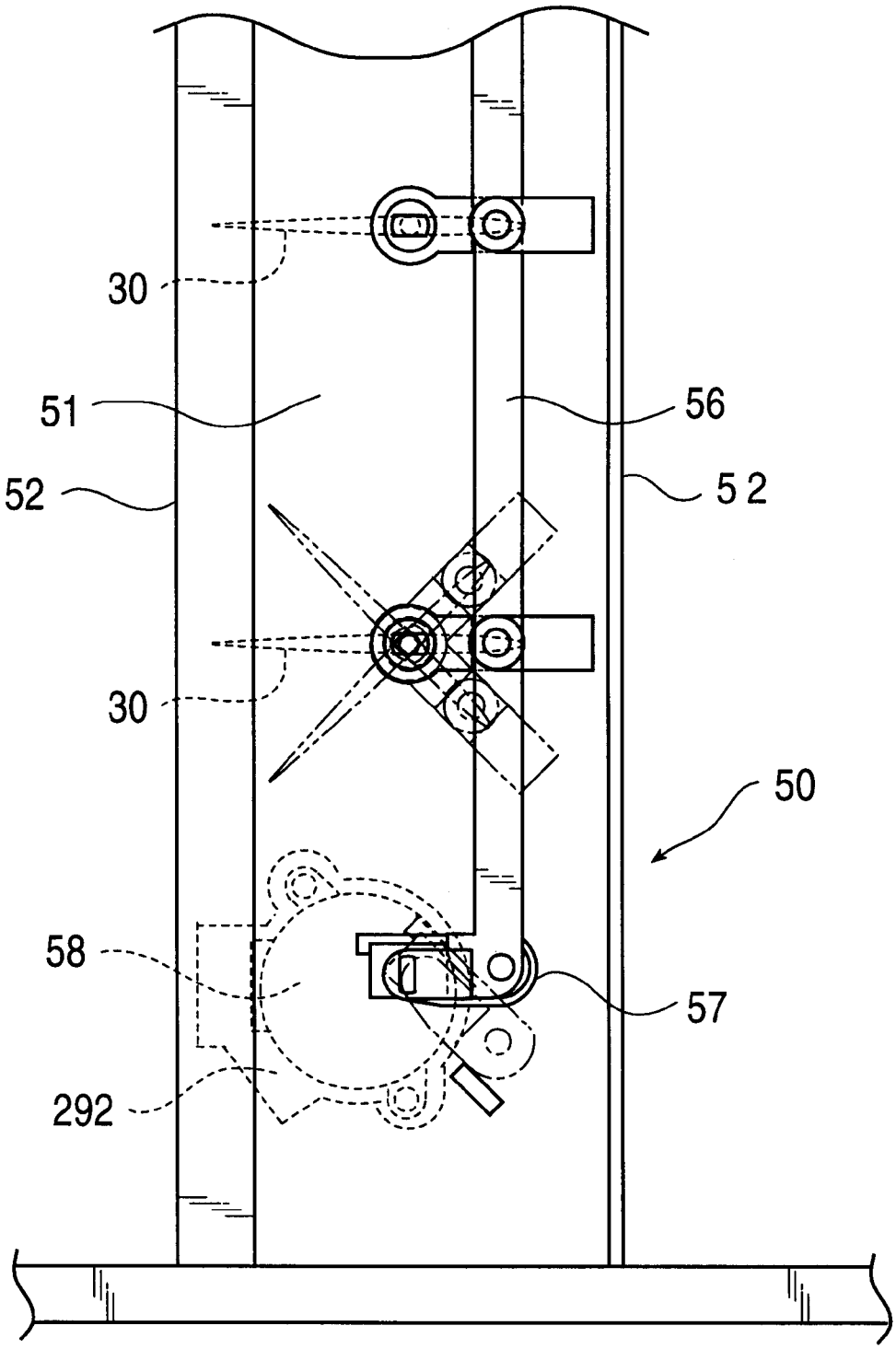
FIG. 3 is a fragmentary enlarged plan view showing the supporting structure of the wind horizontally directing plate.

FIG. 1 shows only one wind horizontally directing plate 30, but actually, as shown in plan view of FIG. 3, plural wind horizontally directing plates 30 are provided as a group of plates at predetermined spaced-intervals in a direction perpendicular to the paper surface of FIG. 1. All wind horizontally directing plates 30 have the same structure, so that the explanation will be given with one of the wind horizontally directing plates 30.

Figure 2:
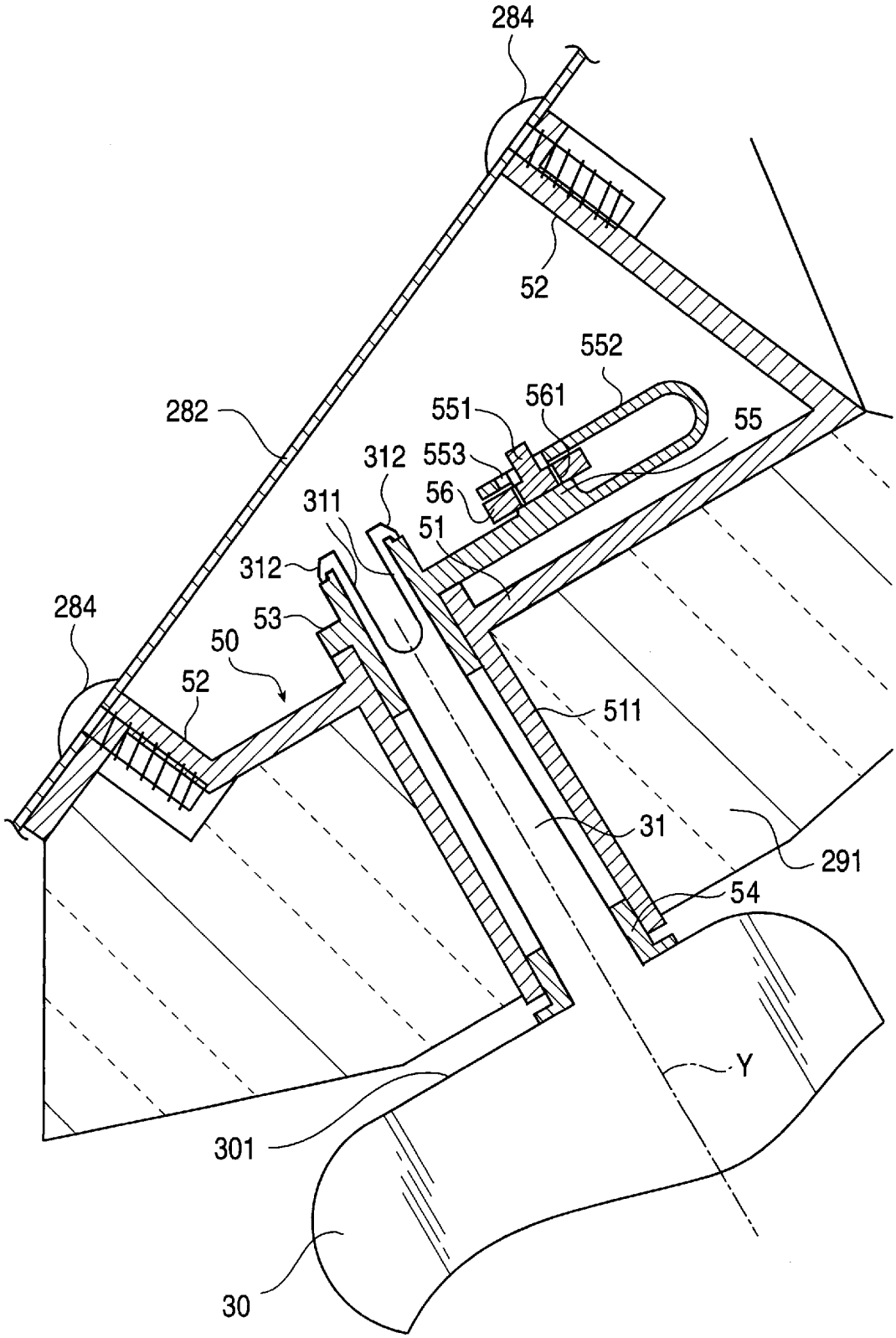
FIG. 2 is a fragmentary enlarged sectional view showing a supporting structure of a wind horizontally directing plate in the first embodiment.

As shown in a fragmentary enlarged sectional view of FIG. 2, the wind horizontally directing plate 30 has a rotating shaft 31 extending from a top side 301 of the plate upward along the rotation axis Y. The rotating shaft 31 has a post shape of an approximate square cross-section (not shown).

On the upper portion of the rotating shaft 31, a pair of engaging portions 311 and 311 which are bifurcated so that they elastically shrink the diameter are provided. Sagittal hooks 312 and 312 are formed at the upper portion of each engaging portion 311 and 311.

A supporting base (louver base) 50 which supports a group of the wind horizontally directing plates 30 is provided on the secondary top plate 282 side. As referring to FIG. 3 together, the supporting base 50 has a supporting base body 51 in a band plate form having a surface orthogonal to the rotation axis Y of the wind horizontally directing plate 30, and side plates 52, 52 which are bent toward the secondary top plate 282 side from both sides of the supporting base body 51. The side plates 52 and 52 are attached to the secondary top plate 282 with screws 284 and 284.

A bearing cylinder portion 511 is formed in the base body 51. The rotating shaft 31 of the wind horizontally directing plate 30 is inserted into the bearing cylinder portion 511. In more detail, bearing bushes 53, 54 are inserted into the upper portion and the lower portion of the bearing cylinder portion 511 respectively, and the rotation shaft 31 is supported in a cantilever type by the bearing cylinder portion 511 at the points of the bearing bushes 53 and 54.

Though not shown in detail, in the bearing bushes 53, 54, almost square shaped insert hole which fits to the rotation shaft 31 of the wind horizontally directing plate 30 is formed and with this structure, the bearing bushes 53, 54 integrally turn with the rotation shaft 31. And at the upper bearing bush 53, the engaging portions 311, 311 of the rotation shaft 31 are inserted while elastically shrink the diameter of their own, and the sagittal hooks 312 and 312 engage with the upper edge of the bearing bush 53 when the engaging portions 311, 311 come out of the insert hole. Thus, the rotation shaft 31 is tightly held by the bearing cylinder portion 511.

In the first embodiment, the bearing bushes 53 and 54 are molded with a synthetic resin having self-lubricity. As for such a resin, there are, for example, polyacetal series resins. Among them, a grade containing wax component is suitable.

An arm 55 extending in parallel with the base body 51, is integrally formed on the upper portion of the bearing bush 53 and a coupling pin 551 is provided on the arm 55. A coupling rod 56 which couples with each wind horizontally directing plate 30, is attached to the coupling pin 551. That is, the coupling rod 56 has a length over the wind horizontally directing plates 30 and coupling holes 561 inserted by the coupling pins 551 at the same spaced-intervals as the space between the wind horizontally directing plates.

At the end portion of the arm 55, a holding portion 552 which is folded back in a nearly U-shape to cover over the coupling pin 551 is provided. The holding portion 552 is provided with a hole 553 which loosely fits with the coupling pin 551. The holding portion 552 can be elastically deformed and is warped back upward by fingers when the coupling rod 56 is attached to and detached from the coupling pin 551 to protect the coupling rod 56 from being detached from the coupling pin 551 in a normal state.

As shown in FIG. 3, one end portion of the coupling rod 56 is connected to a motor 58 for driving the wind horizontally directing plate through a link plate 57. The motor 58 consists of a motor which is reversibly turnable, for instance, a stepping motor, and reciprocatingly turns within a predetermined angle. This turning movement is transferred to each wind horizontally directing plate 30 through a link plate 57, the coupling rod 56, the arm 55 and the bearing bush 53, and thus each wind horizontally directing plate 30 simultaneously performs an oscillation movement to the right and left.

A heat insulation material 291 is adhered on an inner surface of the supporting base 50, namely on an inner surface of the air outlet with a double face adhesive tape, for instance. The heat insulation material 291 is adhered before each wind horizontally directing plate 30 is installed on the supporting base 50 and the bearing cylinder portion 551 strikes through the heat insulation material 291.

As shown in FIG. 1, a stepped recess 292 is formed on the heat insulation material 291, and a motor 58 for driving the wind horizontally directing plates is accommodated in the stepped recess 292. Incidentally, in the first embodiment, still another heat insulation material 293 is adhered on the secondary top plate 282, in front of the heat insulation material 291 when looked from the position of the air outlet 24, but the heat insulation 291 and 293 may be as one.

Figure 4:
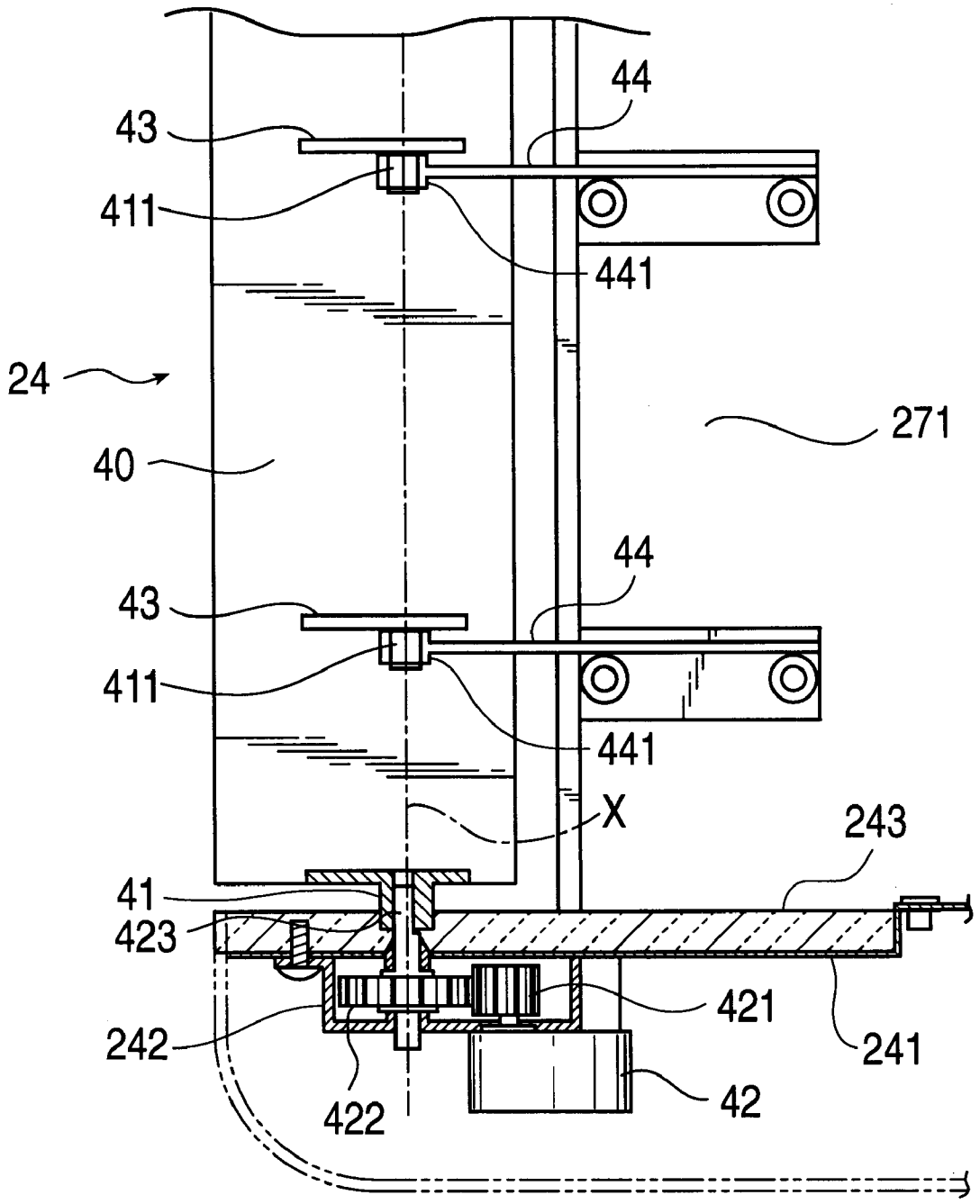
FIG. 4 is a fragmentary enlarged plane view showing a supporting structure of a wind vertically directing plate of the first embodiment.

Though only one side of the wind vertically directing plate 40 is shown in FIG. 4, the wind vertically directing plate 40 is provided with the rotating shaft 41 which is coaxial with a horizontally rotating axis X on both sides thereof. One of the side plates 241 of the air outlet 24 which is shown in the drawing, has a motor supporting frame 242 on the backside thereof, and the motor 42 for driving the wind vertically directing plate and an output gear 422 which is connected to its drive gear 421 are provided on the motor supporting frame 242.

In the inside surface of the side plate 241, a heat insulation material 243 is adhered. An output shaft 423 of an output gear 422 is protruded in the air outlet 24, piercing the heat insulation material 243, and one of the rotating shaft 41 of the wind vertically directing plate 40 is connected to the output shaft 423. Incidentally, the other rotating shaft is held by inserting into the bearing hole on the other side plate which is not shown in the figure, and a heat insulation material is adhered in the same way on the inside surface of the other side plate.

Several rotating shafts 411 are provided at predetermined spaced-intervals on the middle portion of the wind vertically directing plate 40. In this embodiment, the middle rotating shaft 411 is integrally formed so that it is coaxial with the rotating shafts 41 which are on both sides, in regard to a rib plate 43 which stands on the back of the wind vertically directing plate 40.

A hinge 44 which supports the middle rotating shaft 411 in a rotatable manner is provided on the edge portion beside the air outlet 24 of a drain pan 271. The hinge 44 is formed of a triangular board in which a portion attached to the drain pan 271 is the base and a portion of the rotating shaft 411 is the vertex, and a nearly U-shaped bearing slot 441 is provided on the vertex portion. It is desirable to mold the hinge as well as the bearing bushes 53 and 54 with a synthetic self-lubricant resin.

In this structure, the wind horizontally directing plates 30 and the wind vertically directing plate 40 are assembled as follows. As to the wind horizontally directing plate 30, each wind horizontally directing plate 30 is attached to the supporting base 50 to which the heat insulation material 291 is adhered in advance. Then, after the motor 58 and each wind horizontally directing plate 30 are connected to each other through the coupling rod 56 on the base body 51, the supporting base 50 is attached to the secondary top plate 282.

As to the wind vertically directing plate 40, after the hinge 44 is attached to the edge portion beside the air outlet 24 of the drain pan 271, the rotating shafts 41, 41 on both sides of the wind vertically directing plate 40 are attached to an output shaft 423 of the motor and a bearing hole provided on a side plate (not shown), and the middle rotating shafts 411 are inserted to bearing slots 441.

A second example of the present invention is explained based on FIG. 5 to FIG. 8. As the second embodiment serves also as a supplementary explanation of the structure of the first embodiment, the same reference numerals will be used to designate the same or similar components as those in the first embodiment.

Figure 5:
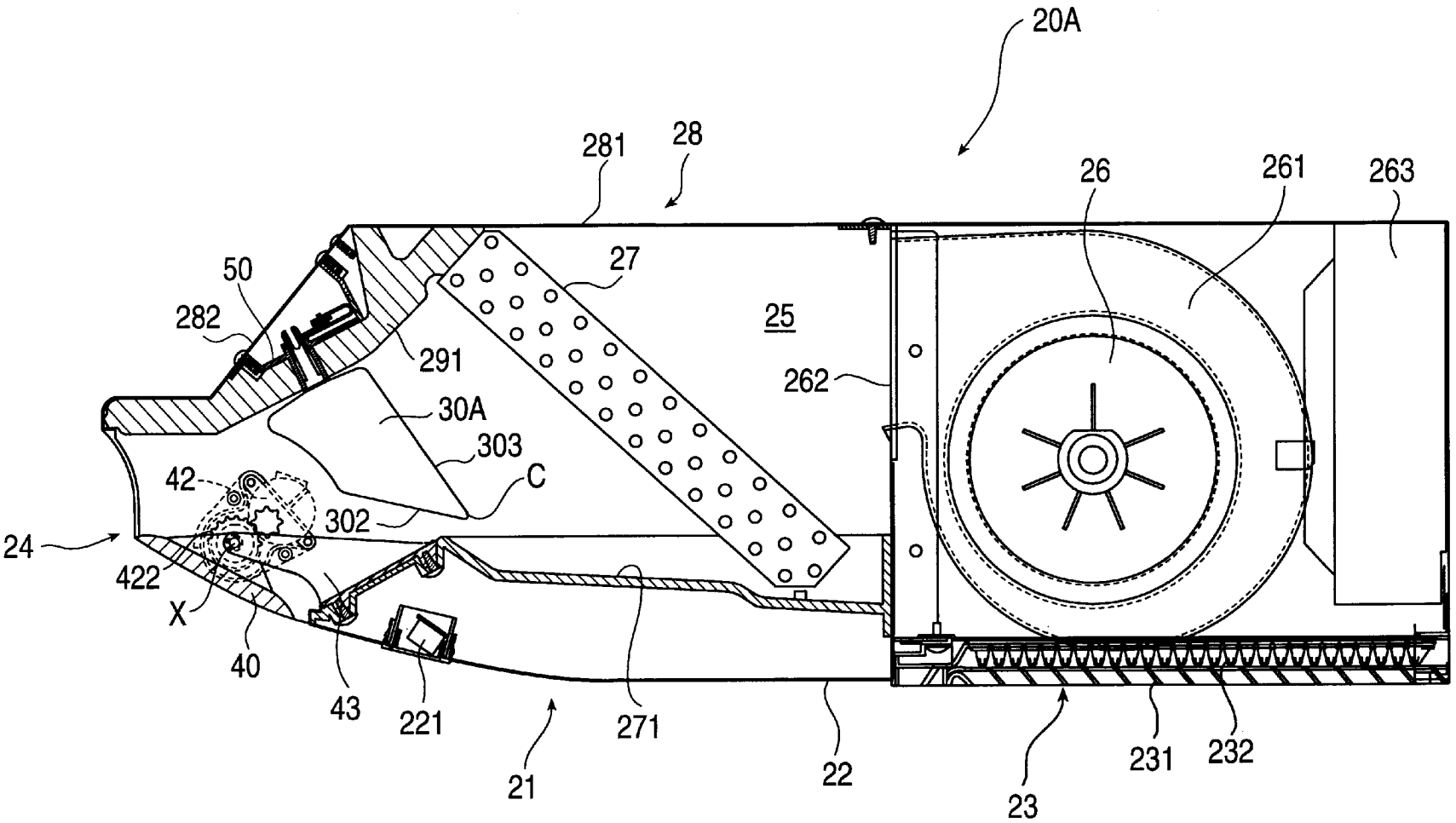
FIG. 5 is a sectional view showing an internal structure of an air conditioner of a second embodiment according to the present invention.

In a sectional view of FIG. 5 showing a whole structure, a ceiling-mounted type air conditioner 20A also has a similar housing 21 as in the first embodiment. What is mainly different from the first embodiment regarding to the housing 21, is that the heat insulation material 291 which is to be provided in the inside surface of the top plate 28 is provided as a unified mold article hanging over from the top portion of the heat exchanger 27 to the air outlet 24, and a light-receptive unit 221 which receives infrared signal from a remote controller is added to the front panel 22.

Since the structure of the wind vertically directing plate 40, the motor 42 as a driving means, and the output gear 422 is substantially similar with the first embodiment, the explanation will be omitted.

In the second embodiment, a wind horizontally directing plate 30A which is different in size and shape from the first embodiment, is used. That is, the lowest portion among bottom sides 302 of the wind horizontally directing plate 30A is positioned above the drain pan 271, so that dewdrops on the wind horizontally directing plate 30A drop on the drain pan 271.

More concretely, in the second embodiment, taking the air blowing direction of the air outlet 24 as a yardstick, an intersection point C of a lateral side 303 with the bottom side 302 of the wind horizontally directing plate 30A is placed at the lowest position of the wind horizontally directing plate 30A and the intersecting point C is positioned above the drain pan 271. With this structure, the shape and size of the drain pan does not need to be particularly changed, so that a conventional drain pan can be used.

Figure 7:
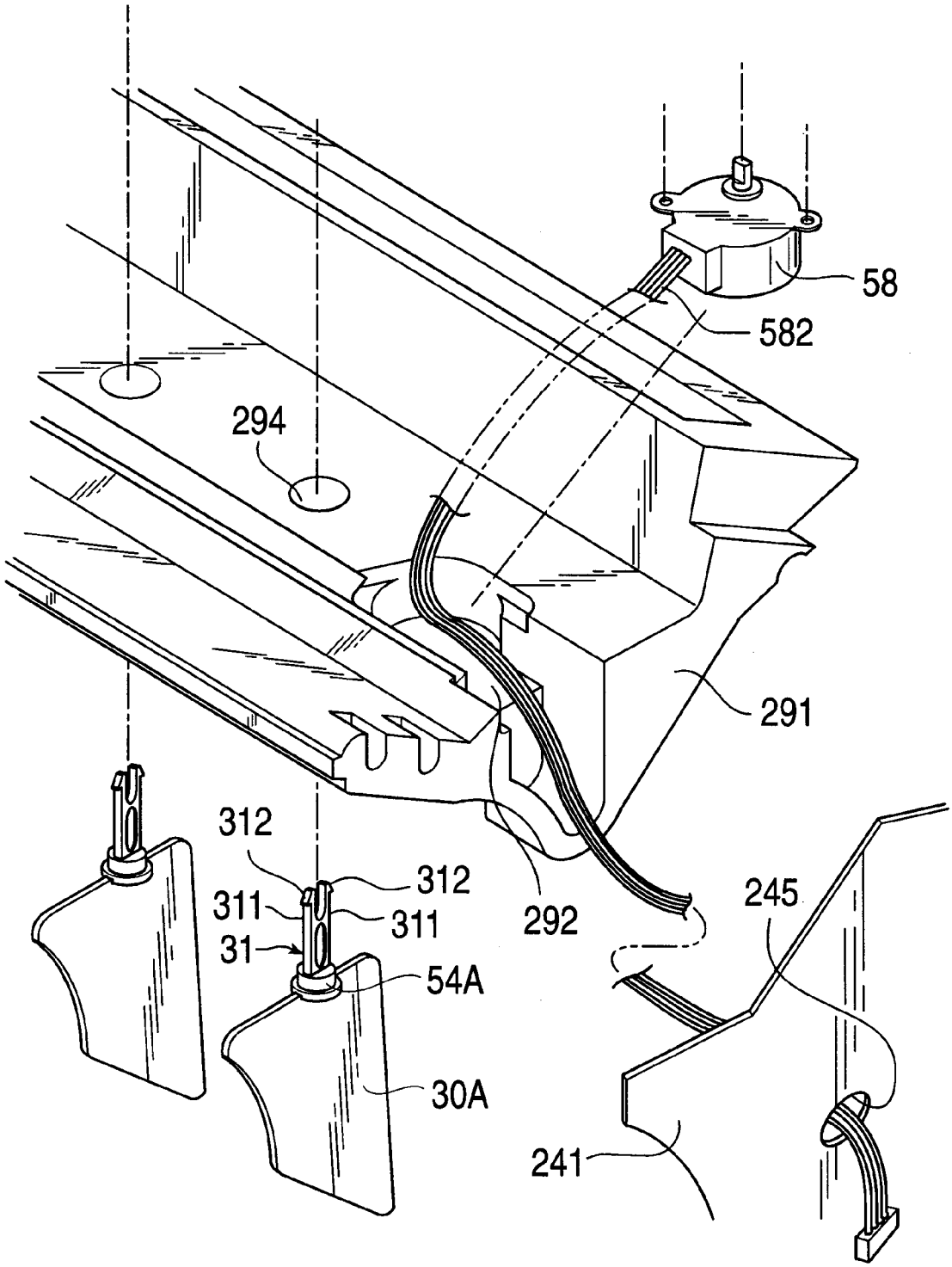
FIG. 7 is an exploded perspective view of the enlarged lower portion of the supporting structure of the wind horizontally directing plate of the second embodiment.

In the second embodiment, material for the wind horizontally directing plate 30A is made of a self-lubricant resin, and as shown in FIG. 7, a bearing bush 54A which corresponds to the lower bearing bush 54 is integrally formed on the base portion of the rotating shaft 31 of the wind horizontally directing plate 30A and the reduction of the parts is aimed.

Figure 6:
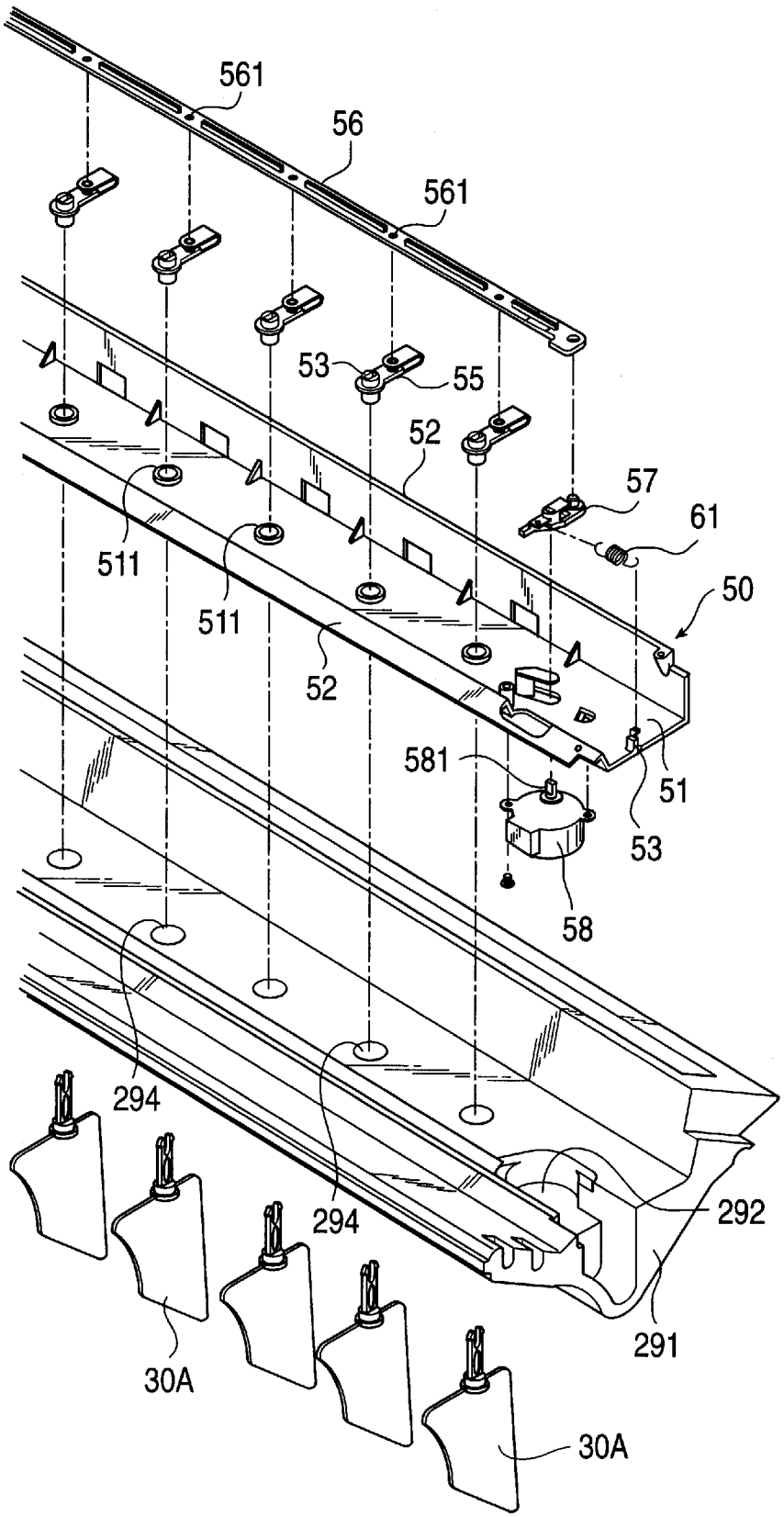
FIG. 6 is an exploded perspective view showing a supporting structure of a wind horizontally directing plate in the second embodiment.
Figure 8:
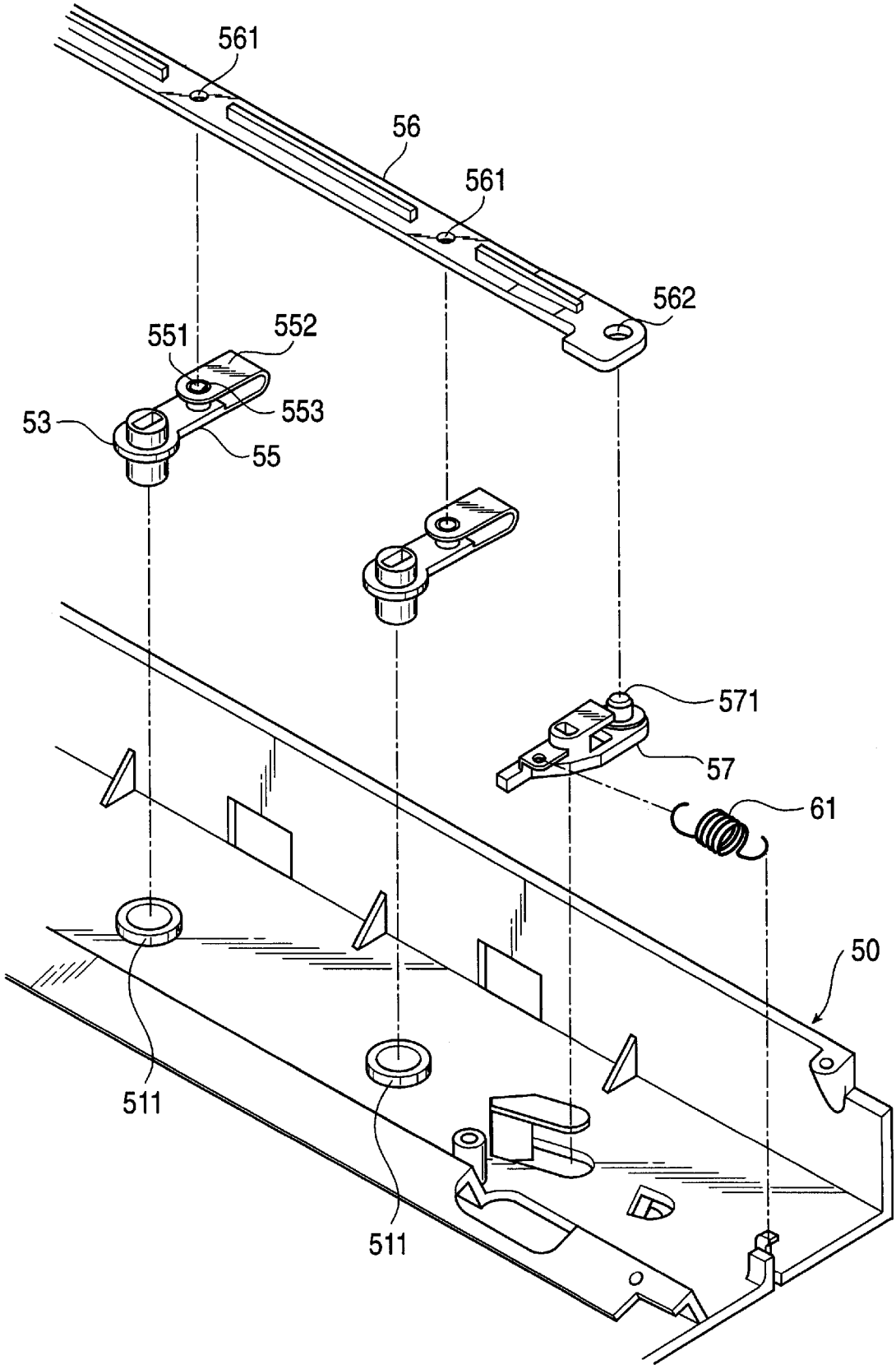
FIG. 8 is an exploded perspective view of the enlarged upper portion of the supporting structure of the wind horizontally directing plate of the second embodiment.

FIG. 6 is an exploded perspective view of each component installed in the supporting base 50, FIG. 7 and FIG. 8 are enlarged fragmentary perspective views of FIG. 6 respectively, and the structure is substantially the same as the structure in the first embodiment. With using these figures, a coupling structure of each wind horizontally directing plate 30A (30) and the construction process are supplementary explained.

Though not explained in the previous first embodiment, the heat insulation material 291 is made from a mold body of, for instance, a plastic foam, many inserting holes 294 to which the bearing cylinder portions 511 are inserted, are formed on the heat insulation material 291 in addition to the stepped recess 292 for housing the motor. The motor 58 is accommodated in the stepped recess 292 and after a wiring cord 582 is pulled out from a hole 245 of the side plate 241 to the outside, the heat insulation material 291 is attached to the supporting base 50 with, for instance, a double-face adhesive tape.

Then, each wind horizontally directing plate 30A is inserted to the bearing cylinder portion 511, a pair of engaging portions 311, 311 is engaged with the upper bearing bush 53, and the wind horizontally directing plate 30A and the bearing bush 53 are unified. And while the direction of each wind horizontally directing plate 30A is arranged in the same direction, the holding portion 552 is folded back upward with fingers, each coupling hole 561 of the coupling rod 56 is coupled into the coupling pin 551 and each wind horizontally directing plate 30A is connected to each other with the coupling rod 56.

Meanwhile the link plate 57 is inserted to a driving shaft 581 of the motor 58. A coupling hole 562 which is provided on end portion of the coupling rod 56 is coupled into a coupling pin 571 of the link plate 57. Then, a tension coil spring 61 is set between the engaging pin 53 which is provided on the end portion of the supporting base 50 and the link plate 57. This coil spring 61 is to restore each wind horizontally directing plate 30A always to the same original position.

Here, the installing of each wind horizontally directing plate 30A to the supporting base 50 is finished, as shown in FIG. 5 as an example, each wind horizontally directing plate 30A is set inside the air outlet 24 by attaching the assembled supporting base 50 on the top plate of the air outlet 24.

The heat insulation material 291 is adhered on the supporting base 50 with a double-face adhesive tape, but in the case of the second embodiment, when the supporting base 50 is attached on the top plate with screws, since both sides of the heat insulation material 291 are pressed toward the top plate, the central portion of the heat insulation material 291 is bent downward, how powerful the adhesive strength of the double-face adhesive tape may be. This may cause contact of the wind horizontally directing plate 30A with the heat insulation material 291, resulting in a failure in the normal rotating movement.

As a problem-solving method, there are two methods. One is to make the heat insulation material 291 thinner, so that the clearance to the wind horizontal directing plate 30A is made wider. The other is to make the tension of the return coil spring 61 bigger. But in the latter case, the heat insulating effect is impaired. Besides, the latter method is undesirable because the load on the motor 58 is increased.

Figure 9:
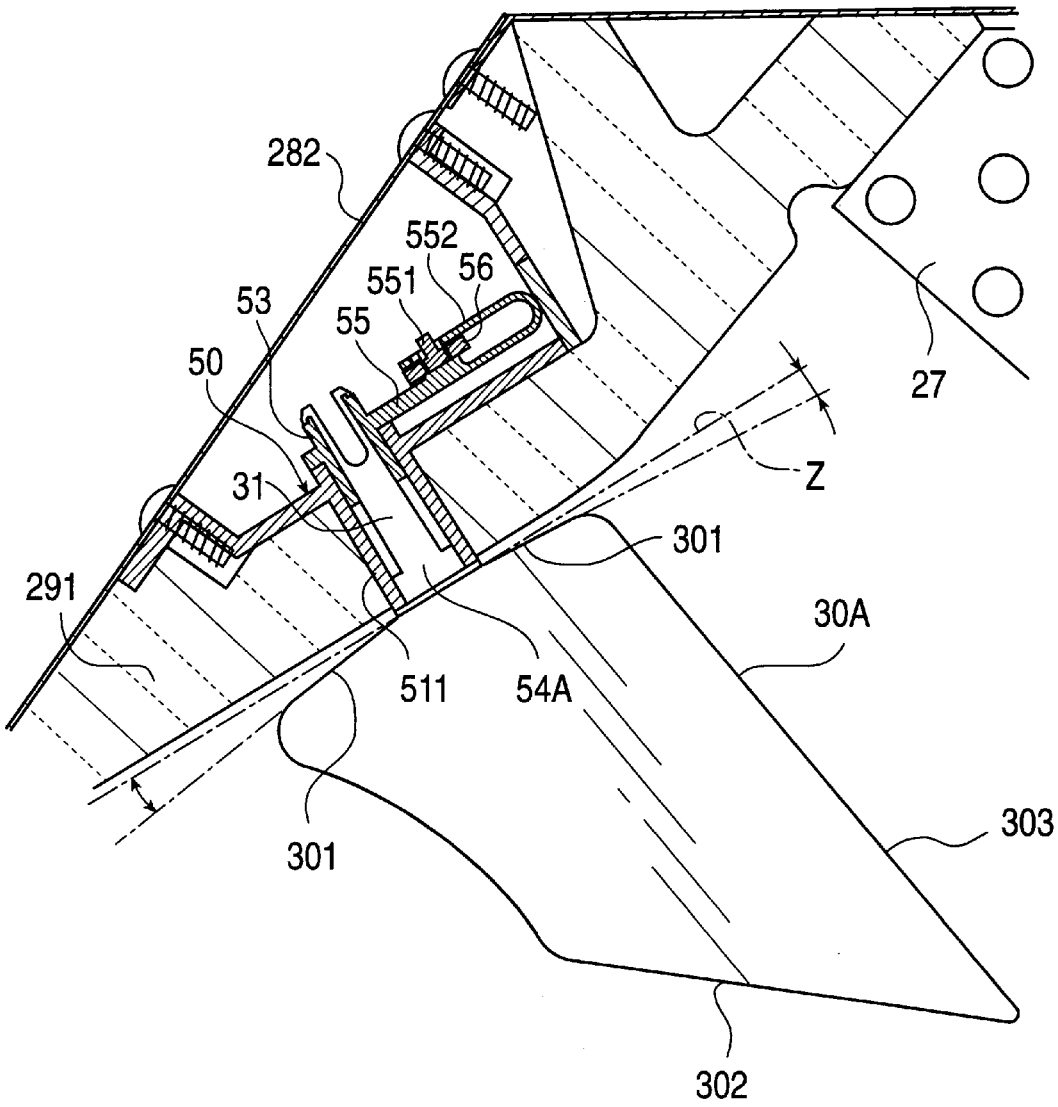
FIG. 9 is a fragmentary sectional view of still another embodiment of the present invention, which is applied to the second embodiment.
Figure 10:
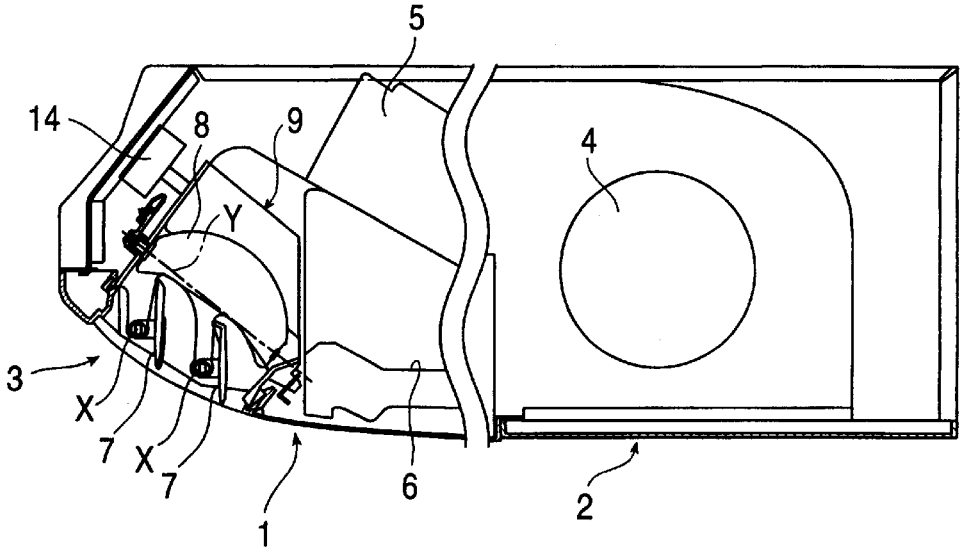
FIG. 10 is a sectional view showing an internal structure of an air conditioner as a conventional example.
Figure 11:
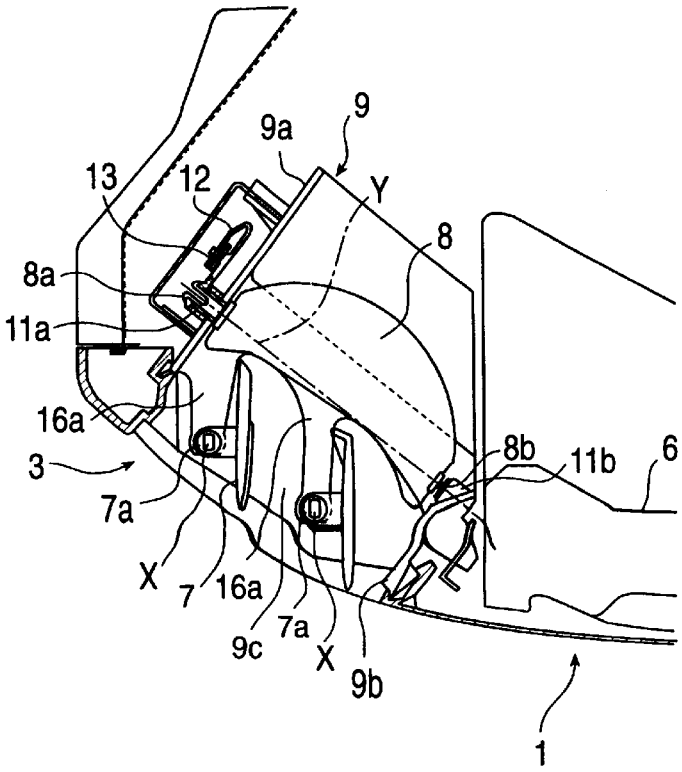
FIG. 11 is an enlarged sectional view of a part of an air outlet of the conventional example.
Figure 12:
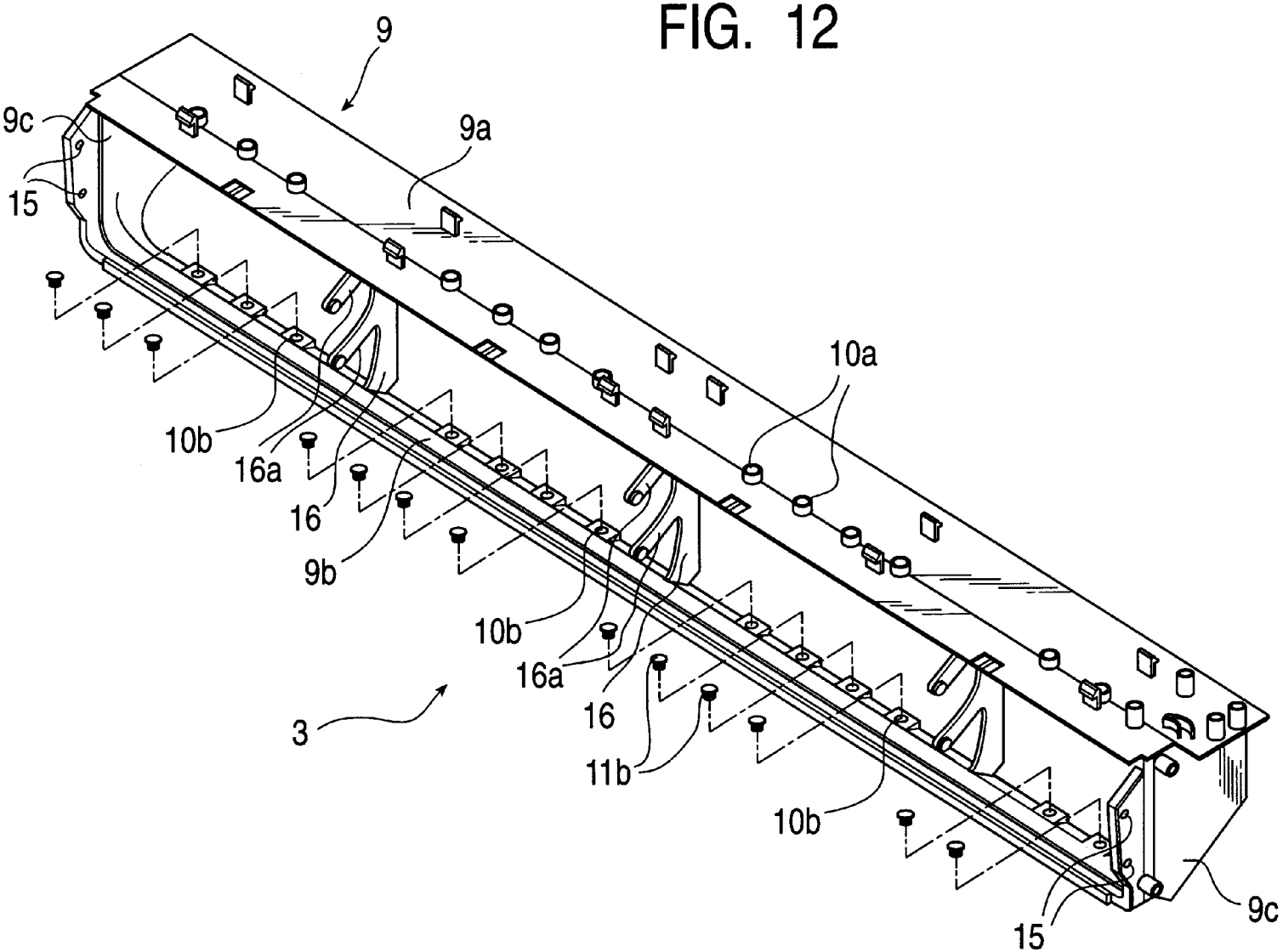
FIG. 12 is a perspective view of a base frame placed in the air outlet of the conventional example.

Therefore, in this invention, as shown in FIG. 9, the wind horizontally directing plate is made in a manner that a line Z which is intersecting at right angles to the rotation axis Y of the rotating shaft 31 is taken as a standard, both shoulder portion of the top side 301 of the rotating shaft 31 of the wind horizontally directing plate 30A is cut off at a predetermined angle from the root of the rotating shaft 31. The cut off angle is preferably about 5 degrees.

According to this formation, even if the heat insulation material 291 is bent downward and the clearance to the wind horizontally directing plate 30A becomes narrow, since only a part around the rotating shaft 31 contacts with the heat insulating material 291, there is no harmful influence to the rotation of the wind horizontally directing plate 30A. Incidentally, the wind horizontally directing plate 30A of the second embodiment is used for the explanation as an example, the method of the invention can be applied to the wind horizontally directing plate 30 in the first embodiment in an analogous fashion.

An air conditioner of each embodiment described above is a ceiling-mounted type, but by changing the shape and size of the drain pan or the arrangement thereof, the present invention can be applied to a wall-mounted type or a floor type air conditioner.

As above, the present invention is explained in detail using concrete embodiments, it will be easy for those skilled in the art who understand the above meaning to think of the change, the modification and the article of equivalency thereof. Therefore, the scope of the present invention should be within the range of the attached claims and the equivalency thereof.

What is claimed is:

1. An air conditioner comprising:

a housing having an air inlet, an air outlet, an air channel situated between the air inlet and air outlet, and a top plate near the air outlet, a heat exchanger provided in the air channel and having a drain pan at a lower portion, a fan situated in the air channel, at least one wind vertically directing plate situated in the air outlet to be rotatable upward and downward around a horizontal rotating axis, a plurality of wind horizontally directing plates situated in the air outlet and arranged side by side to be rotatable toward right and left around respective rotating axes orthogonal to the horizontal rotating axis, each wind horizontally directing plate having a rotating shaft extending upward along the rotating axis from a top side thereof and an engaging member at a top of the rotating shaft, a supporting base attached to the top plate of the housing at a side of the air outlet and having a plurality of bearing cylinder portions, each rotating shaft of the wind horizontally directing plate being inserted into the bearing cylinder portion, a heat insulating material adhered onto the supporting base at the side of the air outlet, said bearing cylinder portions passing through the heat insulating material from a side of the supporting base, and a plurality of sets of first and second bearing bushes, each first bearing bush being situated at an upper portion of the bearing cylinder portion and each second bearing bush being situated at a lower portion of the bearing cylinder portion, said rotating shaft being inserted to the bearing cylinder portion by passing through the second bearing bush and non-rotatably engaging the first bearing bush by the engaging member so that each wind horizontally directing plate is supported in a cantilever style to the supporting base.

2. The air conditioner according to claim 1, wherein the first and second bushes are molded with synthetic resin which is self-lubricant.

3. The air conditioner according to claim 1, wherein the wind horizontally directing plate is formed of a self-lubricant resin; and wherein the second bush is integrally formed with the rotating shaft.

4. The air conditioner according to claim 1, further comprising a coupling rod, each of the first bearing bush having an arm integrally formed therewith, said coupling rod being rotatably connected to the arms of the first bearing bushes so that the wind horizontally directing plates are connected to each other through the coupling rod.

5. The air conditioner according to claim 4, wherein the coupling rod is formed with a plurality of coupling holes at predetermined spaced-intervals; and wherein the arm is provided with a coupling pin inserted into the coupling hole, and a flexible holding portion holding the coupling rod which is inserted by the coupling pin in a detachable manner.

6. The air conditioner according to claim 4, wherein said first bearing bush with the arm is situated on the supporting base to rotatably hold the wind horizontally directing plate, and includes a coupling pin projecting upwardly from the arm to rotatably engage the coupling rod and a flexible holding portion with a hole extending outwardly from the arm, said hole engaging the coupling pin to hold the coupling rod between the flexible holding portion and the arm.

7. The air conditioner according to claim 1, wherein a storage recess accommodating a driving device of the wind horizontally directing plates is formed on the heat insulation material.

8. The air conditioner according to claim 1, wherein at least a hinge supporting a middle portion of the rotating shaft of the wind horizontally directing plate is provided on the drain pan.

9. The air conditioner according to claim 8, wherein the hinge is molded with a self-lubricant resin.

10. The air conditioner according to claim 8, wherein a driving device of the wind vertically directing plate is provided on an outside surface of a side wall of the air outlet; and wherein a heat insulation material is adhered on an inside surface of the side wall.

11. The air conditioner according to claim 1, wherein a portion positioned lowest among bottom sides of the wind horizontally directing plates is placed on the drain pan so that dewdrops deposited on each wind horizontally directing plate drop in the drain pan.

12. The air conditioner according to claim 11, wherein an intersecting point of a lateral line in an upstream side of the wind horizontally directing plate, taking an air outlet direction of the air outlet as a reference, with the bottom side is placed at a lowest position.

13. The air conditioner according to claim 1, wherein both shoulder portions on a top side are cut off at a predetermined angle from a root portion of the rotating shaft of the wind horizontally directing plate, as regards to an assumed standard line intersecting at a right angle with the rotation axis of the wind horizontally directing plate.

14. The air conditioner according to claim 1, wherein said engaging member includes at least a pair of flat engaging portions inserted into the first bearing bush by elastically reducing the diameter thereof with regard to the first bearing bush and having a hook engaging with an upper edge of the first bearing bush, said rotating shaft and the first bearing bush being connected to each other through the flat engaging portions so that no deviation in rotation occurs between the rotating shaft and the first bearing bush.

* * * * *